US009355768B1

(12) United States Patent
Scherban

(10) Patent No.: US 9,355,768 B1
(45) Date of Patent: May 31, 2016

(54) BATTERY REMOVAL TOOL

(71) Applicant: Le Etta Scherban, Wichita, KS (US)

(72) Inventor: Le Etta Scherban, Wichita, KS (US)

( * ) Notice: Subject to any disclaimer, the term of this patent is extended or adjusted under 35 U.S.C. 154(b) by 0 days.

(21) Appl. No.: 14/639,340

(22) Filed: Mar. 5, 2015

(51) Int. Cl.
*H01F 7/20* (2006.01)
*H01F 7/02* (2006.01)

(52) U.S. Cl.
CPC ..... *H01F 7/0257* (2013.01)

(58) Field of Classification Search
CPC ..... B25B 9/02; B23P 19/00; H01F 7/04; B66C 1/04; B66C 1/20; A63F 9/00
USPC ..... 335/285
See application file for complete search history.

(56) References Cited

U.S. PATENT DOCUMENTS 1,521,173 A * 12/1924 Catching ..... H01F 7/206 294/65.5
2,428,864 A * 10/1947 Boyd ..... H01F 7/0257 294/65.5
2,683,618 A * 7/1954 Long ..... H01F 7/0257 294/65.5
3,169,791 A * 2/1965 Twachtman ..... B25J 1/04 294/65.5
4,575,143 A * 3/1986 Nast ..... B25J 1/04 294/100
4,649,116 A * 3/1987 Daty ..... B03C 1/284 210/222
4,813,729 A 3/1989 Speckhart
5,169,193 A * 12/1992 Stelmach ..... B25J 1/02 294/65.5
5,261,714 A * 11/1993 Slusar ..... B25B 9/00 294/65.5
5,265,887 A * 11/1993 Stelmach ..... B25J 1/02 294/65.5
5,288,119 A 2/1994 Crawford, Jr. et al.
D397,006 S * 8/1998 Coleman, Jr. ..... D8/14
5,799,999 A * 9/1998 Schneider ..... B25B 9/00 294/65.5
5,810,409 A * 9/1998 Hardie ..... B25B 9/00 294/65.5
5,861,789 A * 1/1999 Bundy ..... B25B 23/12 335/284
6,056,339 A * 5/2000 Berger ..... B25B 11/002 294/65.5
D446,701 S * 8/2001 Coleman, Jr. ..... D8/14
6,312,138 B1 * 11/2001 Coleman, Jr. ..... B25B 9/00 294/65.5
6,392,517 B1 * 5/2002 Coleman, Jr. ..... H01F 7/0257 294/65.5
6,428,551 B1 * 8/2002 Hall ..... A61B 17/320758 128/899
6,614,337 B1 * 9/2003 Winnard ..... B25B 11/002 206/350
6,733,511 B2 * 5/2004 Hall ..... A61B 17/320758 600/585
7,378,928 B2 * 5/2008 Chang ..... H01F 7/0226 294/65.5
7,673,912 B2 * 3/2010 Breininger ..... B25B 9/00 294/210
7,726,711 B1 6/2010 Steltzer
8,021,311 B2 * 9/2011 Munoz ..... A61M 25/0009 600/585
8,214,993 B1 * 7/2012 Zemo, Jr. ..... E21B 19/002 29/426.3
8,784,336 B2 * 7/2014 Bown ..... A61M 25/0043 600/434
9,070,544 B1 * 6/2015 Shaps ..... H01K 3/32

* cited by examiner

*Primary Examiner* — Shawki S Ismail
*Assistant Examiner* — Lisa Homza
(74) *Attorney, Agent, or Firm* — Crossley & Stevenson IP Law

(57) ABSTRACT

A battery removal tool including a cylindrical housing having a front segment and a back segment, an opening continuously disposed within a front end of the front segment, a channel disposed within an interior surface of the front segment, a wall laterally disposed between the opening and the channel, a pair of magnets comprising a first magnet and a second magnet, a plurality of hollow cylindrical adjustable grips, and a cap. Each of the plurality of adjustable grips slidingly engages an exterior surface of the front segment.

4 Claims, 4 Drawing Sheets

BATTERY REMOVAL TOOL

BACKGROUND OF THE INVENTION

Various types of battery removal tools are known in the prior art. However, what has been needed is a battery removal tool with a plurality of ergonomic fully adjustable cylindrical grips that slidingly engage an exterior surface of a front segment of a cylindrical housing. Thus, a user can slidingly adjust each of the plurality of grips depending on the size of his or her hand. The plurality of grips will also alleviate the often physically taxing task of removing a battery. Such a device will be particularly beneficial for a user who has limited dexterity or mobility in his or her fingers. What has also been needed is a pair of magnets comprising a first magnet and a second magnet, with the first magnet and the second magnet continuously disposed within an opening and a channel, respectively, within the housing.

FIELD OF THE INVENTION

The present invention relates to battery removal tools, and more particularly, to a battery removal tool with a pair of magnets and a plurality of adjustable grips.

SUMMARY OF THE INVENTION

The general purpose of the present battery removal tool, described subsequently in greater detail, is to provide a tool which has many novel features that result in a battery removal tool which is not anticipated, rendered obvious, suggested, or even implied by prior art, either alone or in combination thereof.

To accomplish this, the present battery removal tool comprises a cylindrical housing having a front segment and a back segment. Each of the front segment and the back segment has a front end, a back end, and an exterior surface. The front segment has an interior surface. An opening is continuously disposed within the front end of the front segment. The opening has a C-shaped cross-section. A channel is disposed within the interior surface of the front segment proximal the opening. A wall is laterally disposed between the opening and the channel. A pair of magnets comprises a first magnet and a second magnet. Each of the first magnet and the second magnet has a front side and a back side. The first magnet and the second magnet are continuously disposed within the opening and the channel, respectively. The front side of the first magnet is disposed outside of the housing and the back side of the first magnet is disposed within the housing. The diameter of each of the first magnet and the second magnet is configured to substantially conform to the diameter of the respective opening and channel. The pair of magnets is configured to lift a battery out of a battery receptacle. The type of battery can optionally comprise one of a button cell, a AA, a AAA, and a 9V.

The battery removal tool further comprises a plurality of hollow cylindrical adjustable grips. Each of the plurality of adjustable grips continuously slidingly engages the exterior surface of the front segment. Each of the plurality of adjustable grips is configured to slide forward and backward across the exterior surface of the housing. The diameter of each of the adjustable grips is configured to substantially conform to the diameter of the exterior surface of the housing. Each of the plurality of adjustable grips can optionally be rubberized. A cap is continuously disposed on the exterior surface of the back end of the back segment. The cap can optionally be rubberized.

Thus has been broadly outlined the more important features of the present battery removal tool so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 6 thereof, an example of the instant battery removal tool employing the principles and concepts of the present battery removal tool and generally designated by the reference number 10 will be described.

Figure 1:
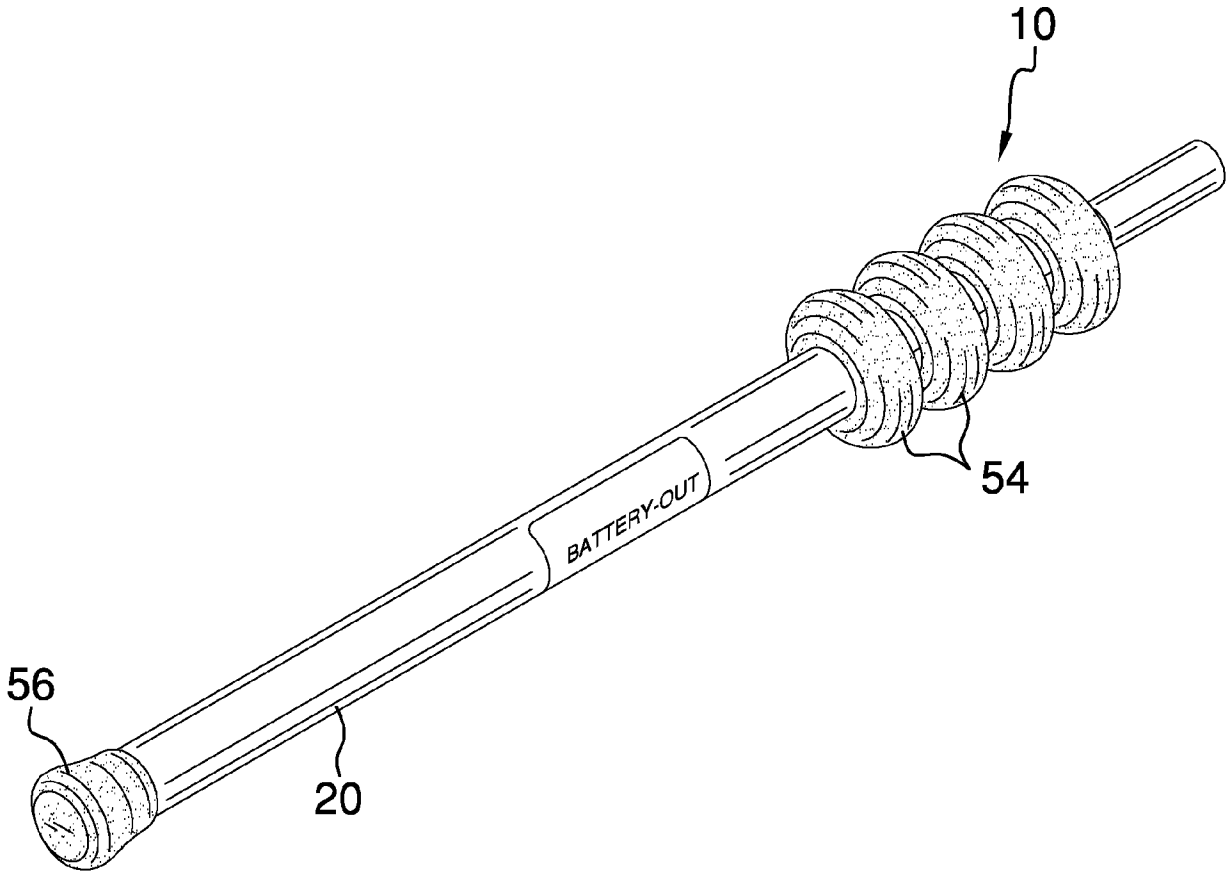
FIG. 1 is a front isometric view.
Figure 2:
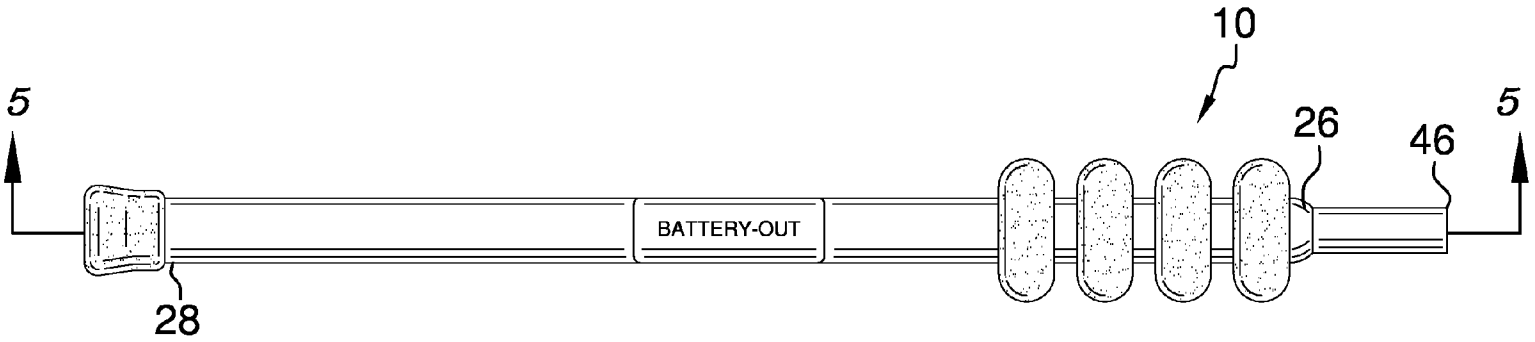
FIG. 2 is a side elevation view showing a plurality of adjustable grips proximal each other.
Figure 3:
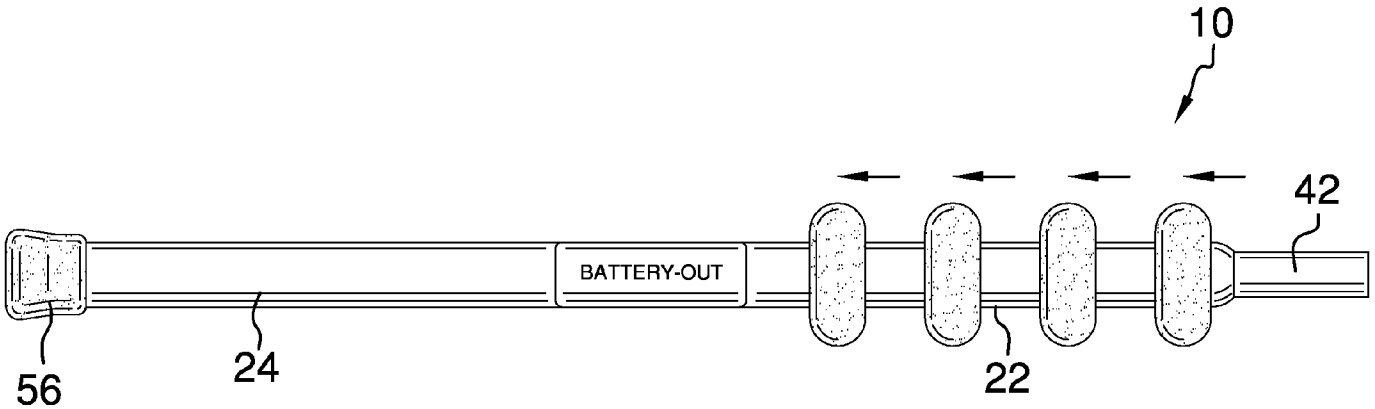
FIG. 3 is a side elevation view showing a plurality of adjustable grips spaced apart from each other.
Figure 4:
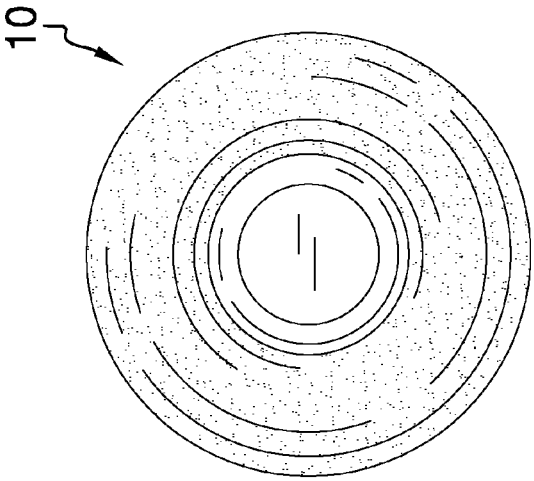
FIG. 4 is a front elevation view.
Figure 5:
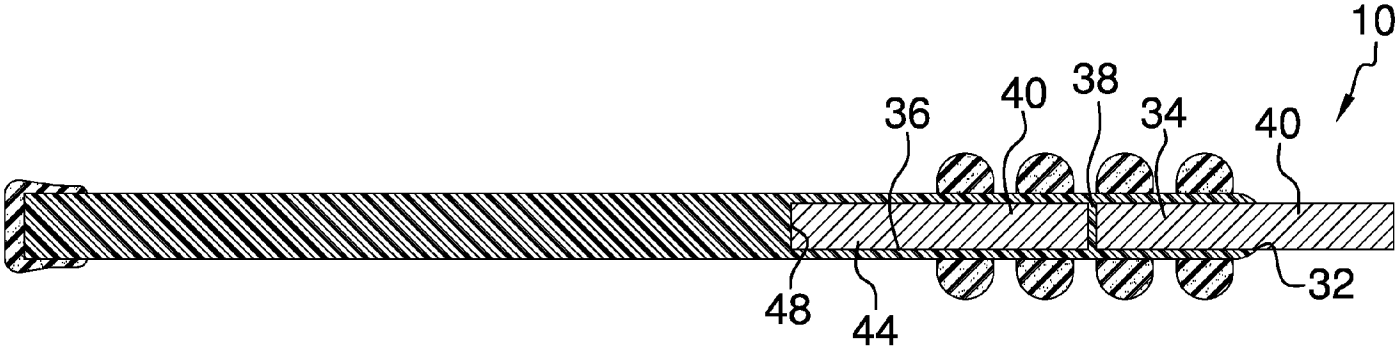
FIG. 5 is a cross-sectional view taken along line 5-5 of FIG. 2.
Figure 6:
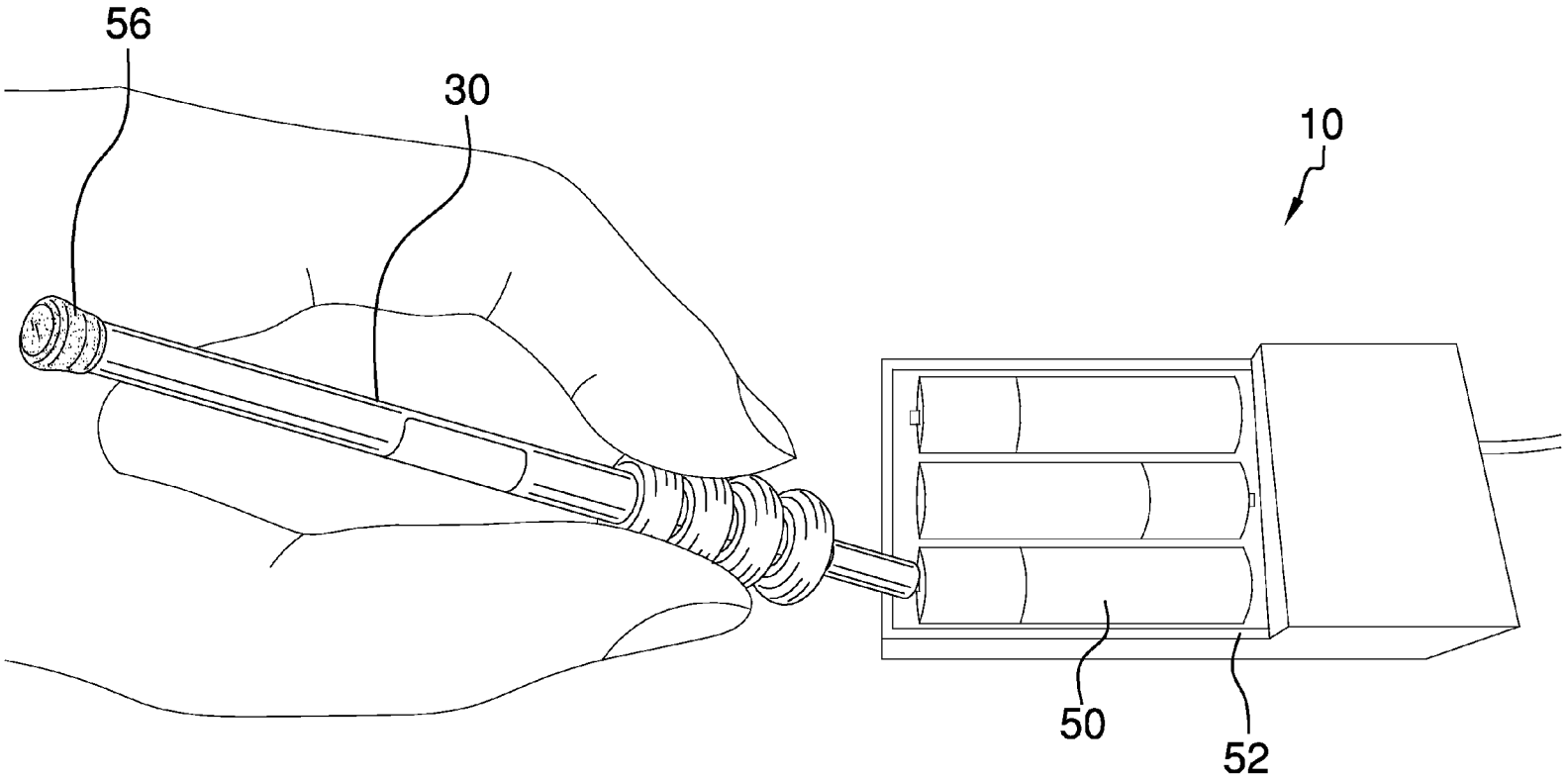
FIG. 6 is an in-use view.

Referring to FIGS. 1 through 6, the present battery removal tool 10 is illustrated. The battery removal tool 10 comprises a cylindrical housing 20 having a front segment 22 and a back segment 24. Each of the front segment 22 and the back segment 24 has a front end 26, a back end 28, and an exterior surface 30. The front segment 22 has an interior surface 32. As best shown in FIG. 5, an opening 34 is continuously disposed within the front end 26 of the front segment 22. The opening 34 has a C-shaped cross-section. A channel 36 is disposed within the interior surface 32 of the front segment 22 proximal the opening 34. A wall 38 is laterally disposed between the opening 34 and the channel 36. A pair of magnets 40 comprises a first magnet 42 and a second magnet 44. Each of the first magnet 42 and the second magnet 44 has a front side 46 and a back side 48. The first magnet 42 and the second magnet 44 are continuously disposed within the opening 34 and the channel 36, respectively. The front side 46 of the first magnet 42 is disposed outside of the housing 20 and the back side 48 of the first magnet 42 is disposed within the housing 20. As best shown in FIG. 6, the pair of magnets 40 is configured to lift a battery 50 out of a battery receptacle 52.

The battery removal tool 10 further comprises a plurality of hollow cylindrical adjustable grips 54. Each of the plurality of adjustable grips 54 continuously slidingly engages the exterior surface 30 of the front segment 22. A cap 56 is continuously disposed on the exterior surface 30 of the back end 28 of the back segment 24.

What is claimed is:

1. A battery removal tool comprising:

a cylindrical housing having a front segment, a back segment, each of the front segment and the back segment having a front end, a back end, and an exterior surface, the front segment having an interior surface;

an opening continuously disposed within the front end of the front segment, the opening having a C-shaped cross-section;

a channel disposed within the interior surface of the front segment proximal the opening;

a wall laterally disposed between the opening and the channel;

a pair of magnets comprising a first magnet and a second magnet, each of the first magnet and the second magnet having a front side and a back side, the first magnet and the second magnet continuously disposed within the opening and the channel, respectively;

wherein the front side of the first magnet is disposed outside of the housing and the back side of the first magnet is disposed within the housing;

wherein the diameter of each of the first magnet and the second magnet is configured to substantially conform to the diameter of the respective opening and channel;

a plurality of hollow cylindrical adjustable grips, each of the plurality of adjustable grips continuously slidingly engaging the exterior surface of the front segment;

wherein each of the plurality of adjustable grips is configured to slide forward and backward across the exterior surface of the housing;

wherein the diameter of each of the adjustable grips is configured to substantially conform to the diameter of the exterior surface of the housing; and a cap continuously disposed on the exterior surface of the back segment back end;

wherein the pair of magnets is configured to lift a battery out of a battery receptacle.

2. The battery removal tool of claim 1 wherein each of the plurality of adjustable grips is rubberized.

3. The battery removal tool of claim 1 wherein the cap is rubberized.

4. A battery removal tool comprising:

a cylindrical housing having a front segment, a back segment, each of the front segment and the back segment having a front end, a back end, and an exterior surface, the front segment having an interior surface;

an opening continuously disposed within the front end of the front segment, the opening having a C-shaped cross-section;

a channel disposed within the interior surface of the front segment proximal the opening;

a wall laterally disposed between the opening and the channel;

a pair of magnets comprising a first magnet and a second magnet, each of the first magnet and the second magnet having a front side and a back side, the first magnet and the second magnet continuously disposed within the opening and the channel, respectively;

wherein the front side of the first magnet is disposed outside of the housing and the back side of the first magnet is disposed within the housing;

wherein the diameter of each of the first magnet and the second magnet is configured to substantially conform to the diameter of the respective opening and channel;

a plurality of hollow cylindrical adjustable grips, each of the plurality of adjustable grips continuously slidingly engaging the exterior surface of the front segment;

wherein each of the plurality of adjustable grips is configured to slide forward and backward across the exterior surface of the housing;

wherein the diameter of each of the adjustable grips is configured to substantially conform to the diameter of the exterior surface of the housing;

wherein each of the plurality of adjustable grips is rubberized; and a cap continuously disposed on the exterior surface of the back segment back end;

wherein the cap is rubberized;

wherein the pair of magnets is configured to lift a battery out of a battery receptacle.

* * * * *